US010278481B2

(12) United States Patent
Toyras

(10) Patent No.: US 10,278,481 B2
(45) Date of Patent: May 7, 2019

(54) MESSENGER BAG SYSTEM

(71) Applicant: Damia Toyras, Marquette, MI (US)

(72) Inventor: Damia Toyras, Marquette, MI (US)

( * ) Notice: Subject to any disclaimer, the term of this patent is extended or adjusted under 35 U.S.C. 154(b) by 0 days.

(21) Appl. No.: 15/720,200

(22) Filed: Sep. 29, 2017

(65) Prior Publication Data

US 2018/0092454 A1 Apr. 5, 2018

Related U.S. Application Data

(60) Provisional application No. 62/402,453, filed on Sep. 30, 2016.

(51) Int. Cl.

| | |
|---|---|
| ***A45F 3/02*** | (2006.01) |
| ***A45C 13/30*** | (2006.01) |
| ***A45C 3/00*** | (2006.01) |
| ***A45F 3/04*** | (2006.01) |

(52) U.S. Cl.

CPC ..... *A45F 3/02* (2013.01); *A45C 3/004* (2013.01); *A45C 13/30* (2013.01); *A45F 3/04* (2013.01); *A45C 2003/005* (2013.01)

(58) Field of Classification Search

CPC ..... A45C 2003/005; A45C 13/30; B62J 9/00; Y10S 224/905; A45F 3/02; A45F 3/004; A45F 3/04

USPC ..... 224/430, 42.11, 609, 417, 655, 236, 578

See application file for complete search history.

(56) References Cited

U.S. PATENT DOCUMENTS

| | | | | | |
|---|---|---|---|---|---|
| 476,545 | A * | 6/1892 | Marshall | A45F 3/04 | 224/582 |
| 2,405,744 | A * | 8/1946 | Glass | A45C 13/26 | 190/111 |
| 3,938,716 | A * | 2/1976 | Jackson | A45F 4/02 | 224/153 |
| 4,153,092 | A * | 5/1979 | Haslam | A45C 3/00 | 150/108 |
| 4,442,960 | A * | 4/1984 | Vetter | B62J 9/00 | 190/108 |
| D292,847 | S * | 11/1987 | Barker | D3/231 | |
| 4,979,658 | A * | 12/1990 | Baker | A45F 3/04 | 224/153 |
| 5,628,436 | A * | 5/1997 | Jones | B62J 9/00 | 224/148.3 |
| 7,011,241 | B2 * | 3/2006 | Godshaw | A45C 7/0086 | 224/583 |
| 7,568,600 | B2 * | 8/2009 | Godshaw | B62J 9/008 | 224/429 |

* cited by examiner

*Primary Examiner* — Adam J Waggenspack

(74) *Attorney, Agent, or Firm* — Peter K. Hahn; Pillsbury Winthrop Shaw Pittman LLP

(57) ABSTRACT

This disclosure relates to a messenger bag system having two bags and a collapsed and an expanded configuration. The two bags are connected by one or more connecting members. The bag system is configured such that the connecting member(s) can drape over a seat of a chair when the system is in the expanded configuration. Each bag has one or more retaining members. The retaining member(s) of one bag are configured to be adjacent to a retaining member of the other bag when the bags are in the collapsed configuration. A securing member is used to secure adjacent retaining members to keep the bag system in the collapsed configuration.

13 Claims, 7 Drawing Sheets

Shoulder Strap

MESSENGER BAG SYSTEM

CROSS-REFERENCE TO RELATED APPLICATION

This application incorporates by reference the contents of U.S. Provisional Patent Application No. 62/402,453 filed Sep. 30, 2016 and entitled "MESSENGER BAG SYSTEM," in its entirety.

FIELD OF THE DISCLOSURE

This disclosure relates to a messenger bag system configured to have collapsed and expanded configurations to allow a user to carry the bag in the collapsed configuration and easier access the contents of the bag in the expanded configuration.

BACKGROUND

Messenger type bags are well known. The typical messenger bag opens at the top edge. The opening is covered and closed with a flap that is fixedly attached to one side of the bag and is releasable attached to the other side of the bag with a clasp or snap or other closure device. Common messenger bags include a shoulder strap to allow the weight of the bag to be carried on the shoulder of the user.

In order to access the contents of the bag the bag is typically laid on a table. Alternatively, the bag can be set on the ground. Neither of these options is ideal if the user is sitting and/or needs to move around the room.

SUMMARY

The present invention is an improved messenger bag system. The bag system includes a first bag and a second bag. Each of the bags includes a main compartment that opens at the top when the bag is in the upright position. The opening of the bag is covered by a flap. In one embodiment of the invention the flap is fixedly attached to one side of the bag and is releasably attachable to the other side of the bag. In another embodiment, the flap is releasably attached to both sides of the bag to allow removal of the flap from the bag. In yet another embodiment the flap is fixedly attached to one side of the bag along the center portion of the flap edge and includes snaps at the outer portions of that flap edge. The other edge of the flap is releasably attached to the other side of the bag.

The two bags of the messenger bag system are connected to each other by one or more connecting members. The messenger bag system has collapsed and expanded configurations. In the expanded configuration the connecting members allow the bag system to be draped over the seat portion of a chair such that one bag is suspended on each side of the seat portion. In the collapsed configuration the bags are retained adjacent to each other to facilitate carrying of the bag by the user.

In one embodiment of the invention, a single connecting member can be used. In this embodiment the connecting member can be a strip of material like canvas, nylon, leather or other durable material. Preferably the width of the material is wide enough to support the weight of each bag and to keep each bag stable during use. In another embodiment of the invention two or more connecting members are used. These connecting members can be canvas, leather or other materials. In one embodiment the connecting members are made of material like nylon seat belt webbing. The two connecting members are sufficiently strong to support the weight of the two bags and are sufficiently spaced apart to keep the bags stable while draped over the seat of a chair.

In one embodiment of the invention, the connecting members are of a fixed length. Each end of each connecting member is connected to one of the bags so that the two bags are connected by the connecting members. In another embodiment of the invention each connecting member includes a slide member that allows the length of each connecting member to be adjusted to accommodate different seat widths.

In another embodiment of the invention, the connecting members can be releasably attached to each bag to allow each of the connecting straps to be removed from the bags.

In one embodiment of the invention, each bag includes one or more retaining members along the upper portion of each bag. In one embodiment, two retaining members are included on each bag adjacent to the location where each of two connecting members attach to the bag. The retaining members are used to maintain the bag system in the collapsed configuration. In the collapsed configuration the two bags are adjacent to each other. In this configuration each of the retaining members is adjacent to a retaining member of the other bag. Adjacent retaining members are releasably maintained in proximity to their adjacent retaining member by a securing member connecting the adjacent retaining members. In one embodiment of the invention a securing member is at each end of a shoulder strap. The shoulder strap may include a slide member to allow the length of the shoulder strap to be adjusted.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

In the following paragraphs, implementations of the present disclosure will be described in detail by way of example with reference to the accompanying drawings, which are not necessarily drawn to scale, and the illustrated components are not necessarily drawn proportionately to one another. Throughout this description, the implementations and examples shown should be considered as exemplars, rather than as limitations on the present disclosure. As used herein, the "present disclosure" refers to any one of the embodiments of the disclosure described herein, and any equivalents. Furthermore, reference to various aspects of the disclosure throughout this document does not mean that all claimed embodiments or methods must include the referenced aspects.

Figure 1:
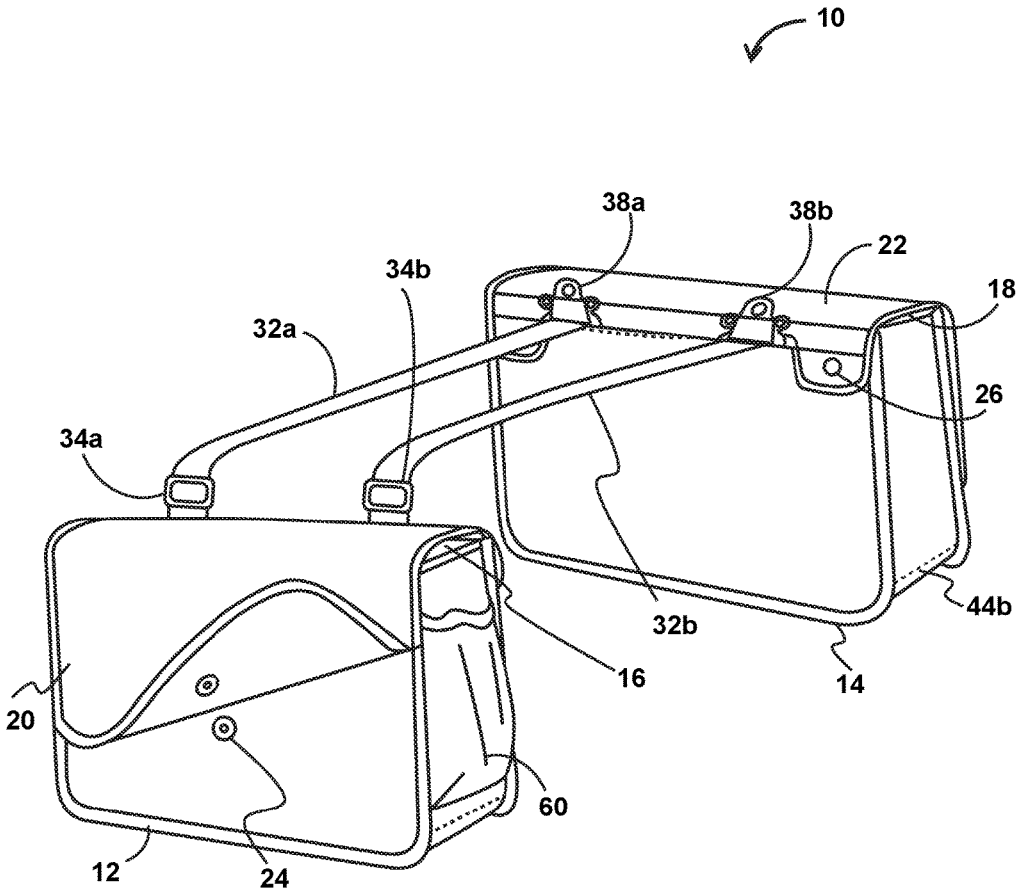
FIG. 1 illustrates one embodiment of a messenger bag system of the present invention showing the bag system in the expanded configuration.

FIG. 1 illustrates a messenger bag system 10 comprising a first bag 12, a second bag 14, and/or other components. Bags 12, 14 can be made of a variety of materials including cloth, leather, canvas, nylon or other durable materials known in the art. In one embodiment of the invention the material used is Cordura®. Each of the bags 12, 14 includes a main compartment 16, 18 that opens at the top when the bag is in the upright position. The opening of the bag is covered by a flap 20, 22. In one embodiment of the invention flaps 20, 22 is releasably attached to both sides of bag 12, 14 to allow removal of flap 20, 22 from bag 12,14. As can best be seen in FIG. 1 or 2, flap 20 can be held in the closed position by magnetic snap fastener 24. As those skilled in the art will appreciate, magnetic snap 24 could be replaced by a metal snap, plastic snap, twist and lock connector, pronged snap, hook and loop fastener or other connectors and fasteners known in the art.

Figure 3:
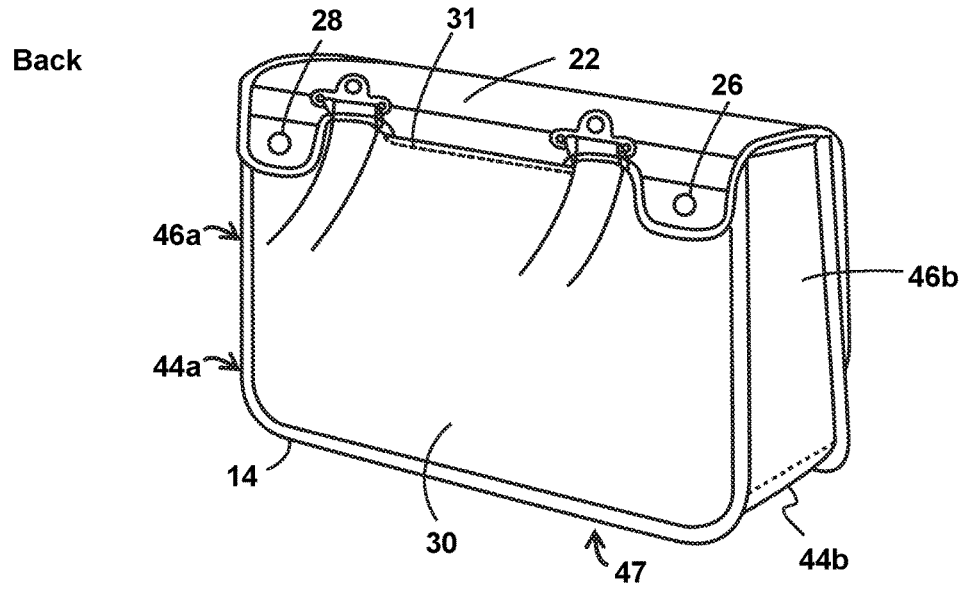
FIG. 3 illustrates one embodiment of a bag of the messenger bag system of the present invention.

As can best be seen in FIG. 3, flap 22 is connected to bag 14 by a pair metal snaps 26, 28. As those skilled in the art will appreciate, snaps 26, 28 could be replaced by a magnetic snap, plastic snap, twist and lock connector, pronged snap, hook and loop fastener or other connectors and fasteners known in the art. In another embodiment of the invention (not shown), flap 22 can be fixedly attached to bag 14 by being an extension of back 30 of bag 14. In yet another embodiment of the invention (not shown), flap 22 can be attached to back 30 by stitching, bonding or other attachment means known in the art. In still another embodiment the flap is fixedly attached to back 30 of the bag along the center portion 31 of the flap edge and includes snaps 26, 28 at the outer portions of that flap edge. The fixed attachment can be an extension of the back 30 or the flap could be sewn or otherwise attached to back 30. The other edge of the flap is releasably attached to the other side of the bag. Use of the fixed attachment in the center portion and releasable attachment at the outer portions allows the flap to be fully opened, passed between connecting members 32*a* and 32*b* and then retained adjacent side 30.

Figure 4:
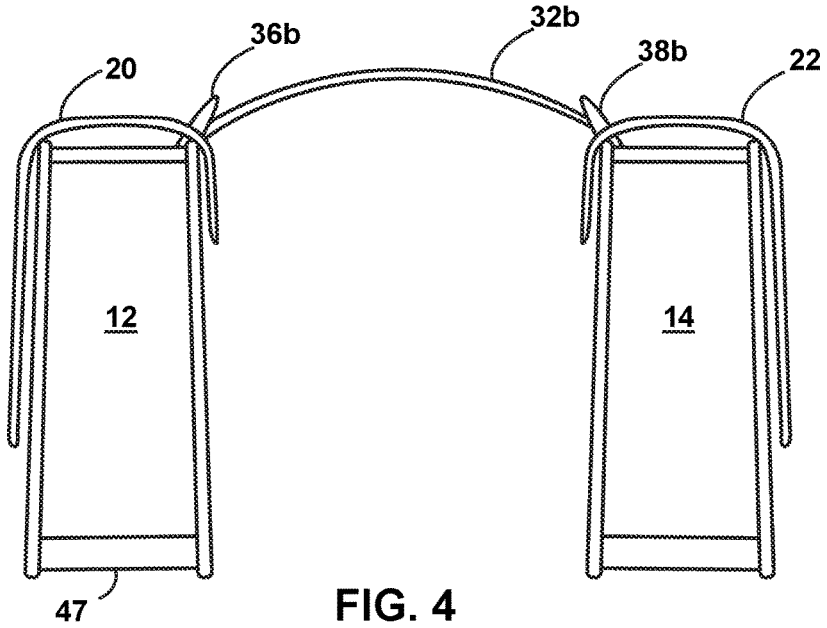
FIG. 4 illustrates one embodiment of a messenger bag system of the present invention showing the bag system in the expanded configuration.
Figure 5:
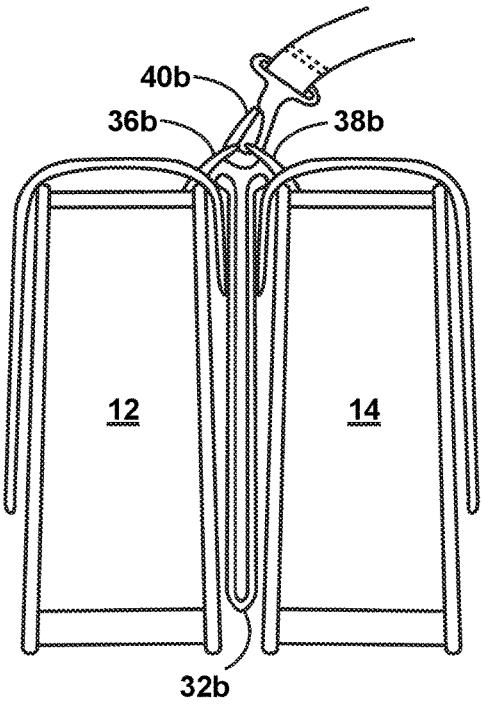
FIG. 5 illustrates one embodiment of a messenger bag system of the present invention showing the bag system in the collapsed configuration.
Figure 6:
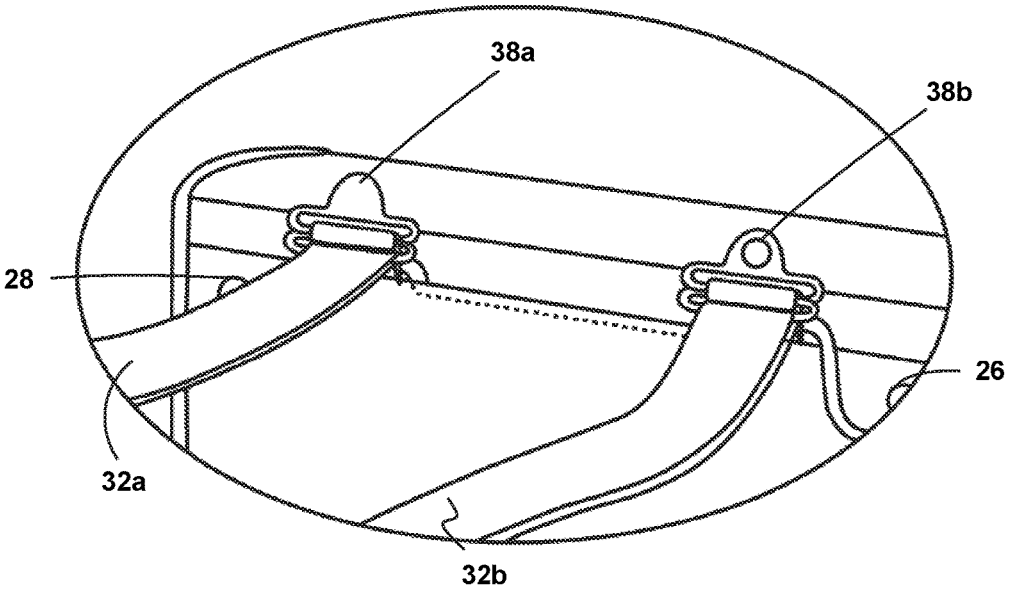
FIG. 6 illustrates connecting member and retaining member attachment points of one embodiment of a messenger bag system of the present invention.

The two bags 12, 14 of the messenger bag system 10 are connected to each other by one or more connecting members. Referring again to FIGS. 1-3. One embodiment of messenger bag system 10 includes connecting members 32*a*, 32*b*. The messenger bag system has collapsed and expanded configurations. In the expanded configuration (shown in FIG. 4) the connecting members 32*a*, 32*b* allow the bag system to be draped over the seat portion of a chair such that one bag is suspended on each side of the seat portion. In the collapsed configuration (shown in FIG. 5) bags 12, 14 are retained adjacent to each other to facilitate carrying of the bag by the user.

In one embodiment of the invention (not shown), a single connecting member 32 can be used. In this embodiment the connecting member can be a strip of material like canvas, nylon, leather or other durable material. Preferably the width of the material is wide enough to support the weight of each bag and to keep each bag stable during use. In another embodiment of the invention (shown in FIGS. 1-3) two or more connecting members are used. These connecting members can be canvas, leather or other materials. In one embodiment the connecting members are made of material like nylon seat belt webbing. In the embodiment shown in FIGS. 1-3, two connecting members 32*a*, 32*b* are included, are sufficiently strong to support the weight of the two bags and are sufficiently spaced apart to keep the bags stable while draped over the seat portion of a chair (not shown).

In one embodiment of the invention (not shown), the connecting members are of a fixed length. Each end of each connecting member is connected to one of the bags so that the two bags are fixedly or releasably connected by the connecting members. In another embodiment of the invention (shown in FIGS. 1-3) each connecting member 32*a*, 32*b* includes a slide member 34*a*, 34*b* that allows the length of each connecting member to be adjusted to accommodate different seat widths. In the depicted embodiment, each end of each connecting member 32*a*, 32*b* is fixedly connected to one of the bags 12, 14 by stitching, bonding etc., so that the two bags are fixedly connected by the connecting members 32*a*, 32*b*. Slide member 34*a*, 34*b* is, in one embodiment, a metal slide member. In another embodiment the slide member is a plastic slide member. As those skilled in the art will appreciate, other strap adjusting mechanisms (e.g., buckles) could be used without departing from the scope of the disclosed invention.

In another embodiment of the invention, the connecting members can be releasably attached to each bag to allow each of the connecting straps to be removed from the bags. As those skilled in the art will appreciate, connecting members could be releasably connected to the bags using releasable connectors and fasteners like metal snaps, plastic snaps, twist and lock connector, pronged snap, hook and loop fastener or other connectors and fasteners known in the art.

Figure 2:
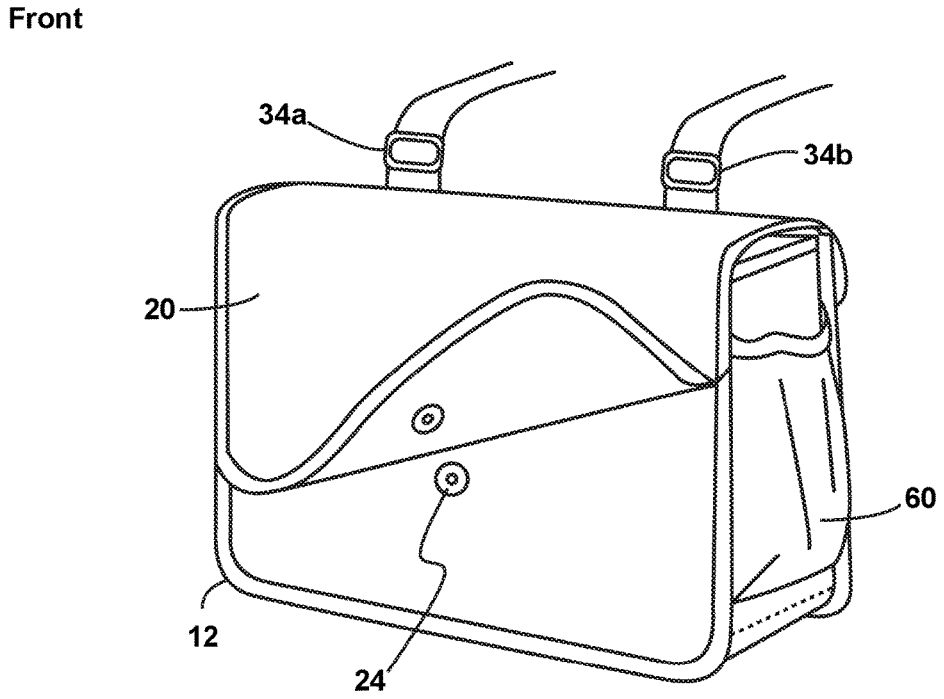
FIG. 2 illustrates one embodiment of a bag of the messenger bag system of the present invention.
Figure 7:
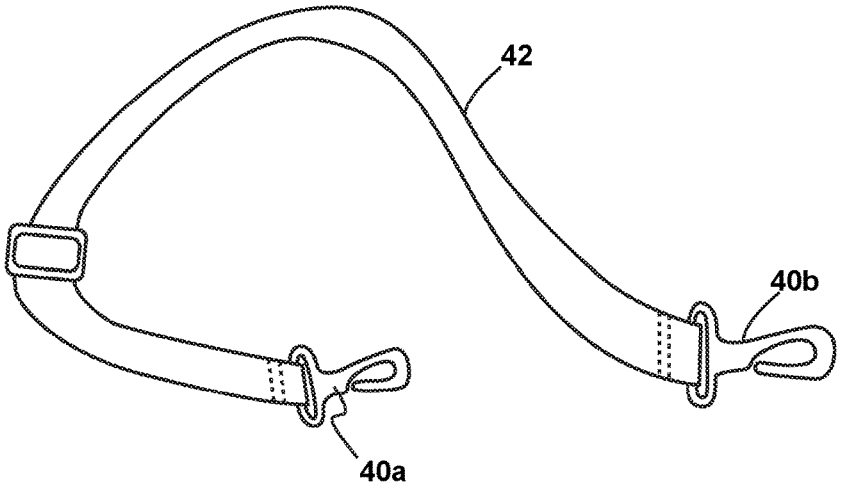
FIG. 7 illustrates the shoulder strap an securing members of one embodiment of a messenger bag system of the present invention.
Figure 8:
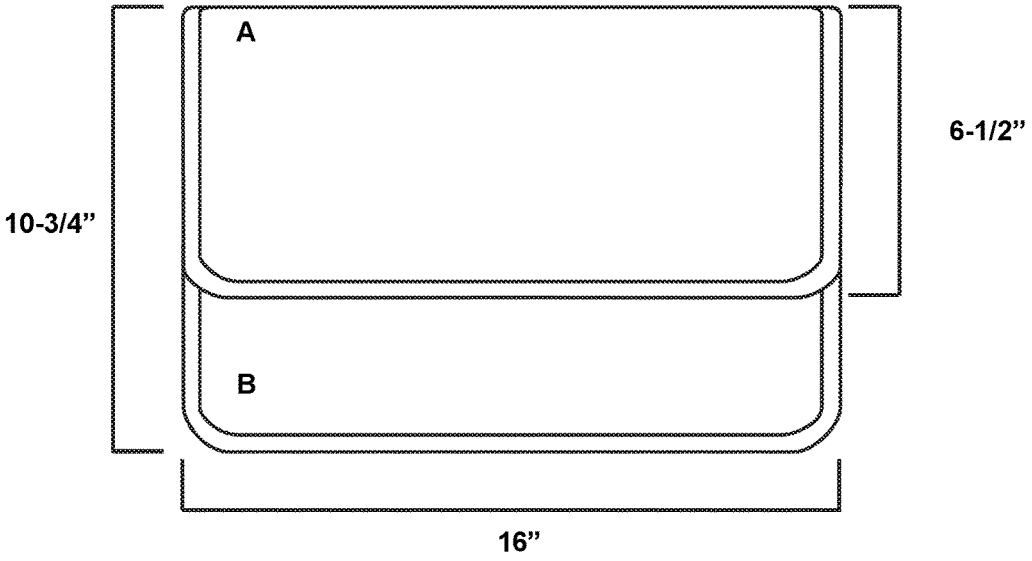
FIG. 8 illustrates dimensions of one embodiment of a messenger bag system of the present invention.
Figure 9:
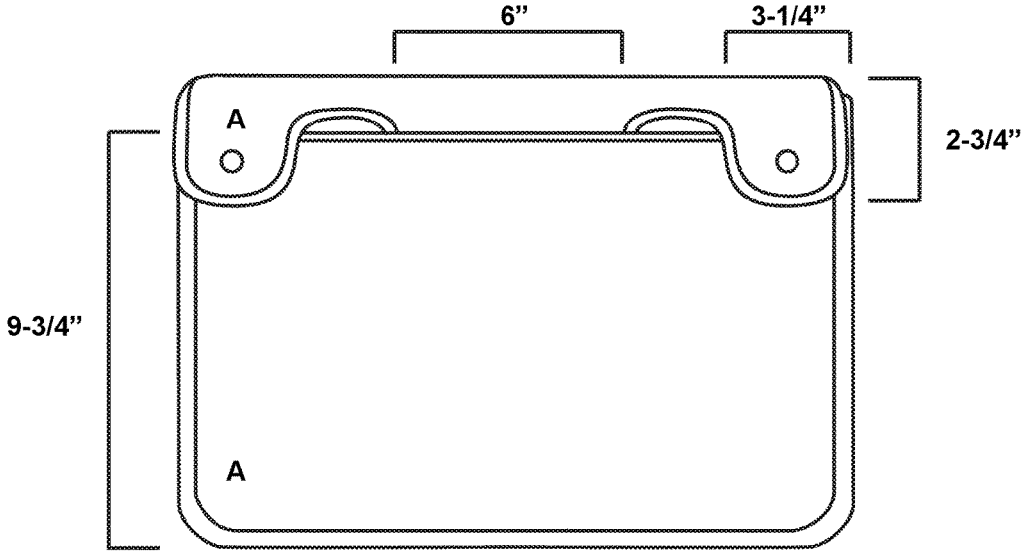
FIG. 9 illustrates dimensions of one embodiment of a messenger bag system of the present invention.

In certain embodiments of the invention, each bag includes one or more retaining members along the upper portion of each bag. In some embodiments (as shown in FIGS. 1-3), two retaining members 36*a* (not shown), 36*b* (shown in FIG. 4-5) or 38*a*, 38*b* (shown) are included on each bag adjacent to the location where each of two connecting members attach to the bag. Connecting members may be made of metal, plastic or other durable material. Retaining members 36, 38 are used to maintain the bag system in the collapsed configuration. In the collapsed configuration the two bags 12, 14 are adjacent to each other. In this configuration each of the retaining members 36*a*, 36*b* of one bag is adjacent to a retaining member 38*a*, 38*b* of the other bag. Adjacent retaining members are releasably maintained in proximity to their adjacent retaining member by a securing member 40*a*, 40*b* connecting the adjacent retaining members. As those skilled in the art will appreciate, securing member 40*a*, 40*b* can be any type of releasable securing member including spring connectors, carabiner connectors, locks etc. In one embodiment of the invention (FIG. 7) a securing member 40*a*, 40*b* is at each end of a shoulder strap 42. Shoulder strap 42 may include a slide member 44 (or other adjusting mechanism) to allow the length of the shoulder strap to be adjusted.

In some embodiments, each bag 12, 14 includes one or more reinforcement bars. In some embodiments, reinforcement bars 44*a*, 44*b* are sewn into the base of each end wall 46*a*, 46*b*. Reinforcement bars 44*a*, 44*b* are useful to reinforce the base of each bag and to keep the base of each bag expanded. Additional reinforcement bars crossing the length of the base will further reinforce the base of the bag. In another embodiment a substantially rigid flat insert (not shown) can be included in the bag base 47 to increase rigidity and to keep the bag base expanded. In yet another embodiment a substantially rigid flat insert (not shown) can be included in end walls 46*a*, 46*b* to increase rigidity and to keep the bag base and sides expanded.

Figure 10:
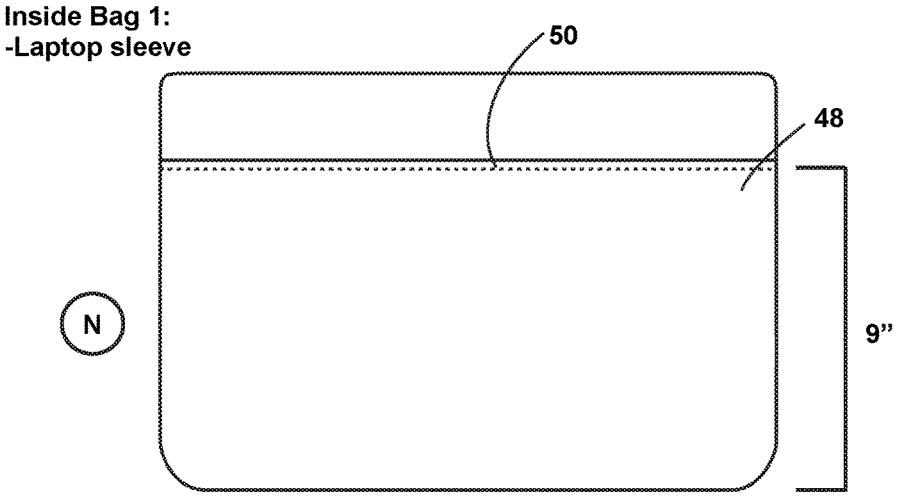
FIG. 10 illustrates dimensions of one embodiment of a messenger bag system of the present invention.

FIG. 10 shows an interior configuration of a bag of an embodiment of the present invention. The interior wall 48 includes a slot and recess 50 configured to receive a laptop computer, tablet computer and the like. Recess 50 can include rigid stabilizer (not shown) to make the wall more rigid and/or padding to protect a computer or other device inserted into recess 50.

Figure 11:
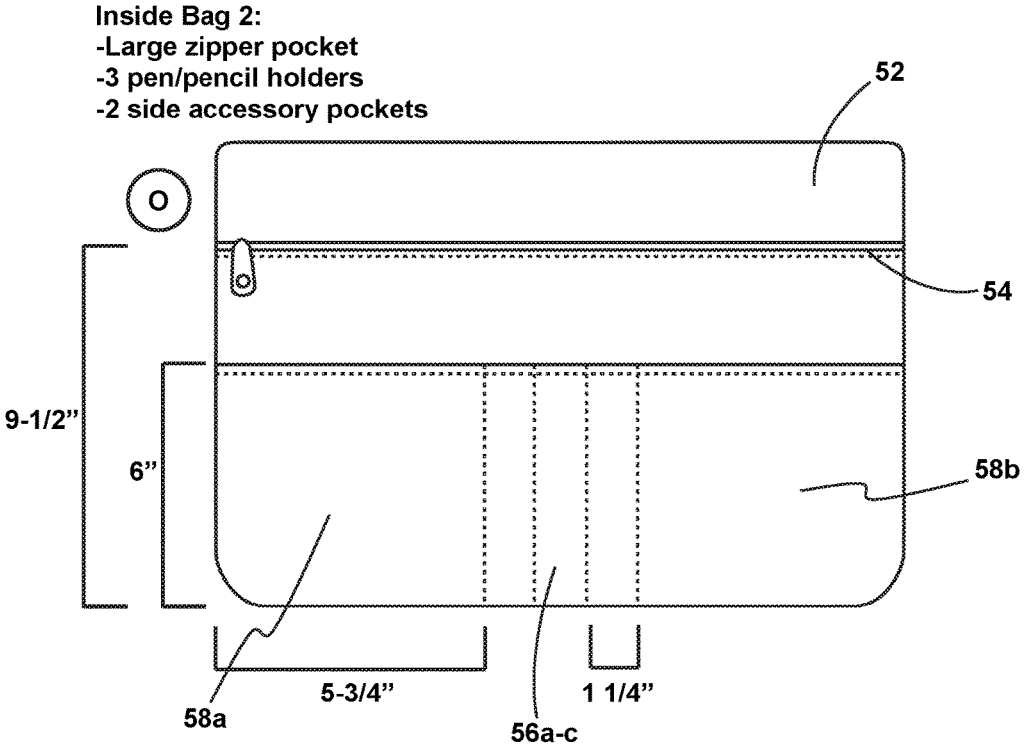
FIG. 11 illustrates dimensions of one embodiment of a messenger bag system of the present invention.

FIG. 11 shows an interior configuration of a bag of an embodiment of the present invention. The interior wall 52 includes a zippered compartment 54, pencil/pen holders 56*a-c* and accessory pockets 58*a*, 58*b*. The exterior of the bag can also include one or more exterior pockets 60. As those skilled in the art will appreciate other or different pockets, compartment and holders could be included without departing from the invention. The interior of each bag can include various liners (not shown). These liners can provide various functionality including moisture resistance, moisture proofing, scuff and mark resistance, etc.

The dimensions of some embodiments are shown in FIGS. 8-11.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A bag system comprising;

a first bag including a first bag interior compartment, a primary first bag retaining member and a first bag flap, said first bag flap having a first bag open position and a first bag closed position;

a second bag including a second bag interior compartment, a primary second bag retaining member and a flap, said flap having a second bag open position and a second bag closed position; and a primary and a secondary connecting member connecting the first bag to the second bag, wherein the first bag flap is fixedly connected to the first bag between the primary and secondary connecting members and is releasably connected to the first bag on at least one exterior side of the primary and secondary connecting members; and a primary securing member configured to releaseably secure the primary first bag retaining member to the primary second bag retaining member wherein the bag system is configured to be in a collapsed configuration when the primary securing member is securing the primary first bag retaining member to the primary second bag retaining member and is configured to be in an expanded configuration when the primary securing member is not securing the primary first bag retaining member to the primary second bag retaining member.

2. The system of claim 1 further comprising a secondary first bag retaining member connected to the first bag, a secondary second bag retaining member connected to the second bag, and a secondary securing member configured to releasably secure the secondary first bag retaining member to the secondary second bag retaining member.

3. The system of claim 2 further comprising a shoulder strap having a first end and a second end, wherein the primary securing member is connected to the first end of the shoulder strap and the secondary securing member is connected to the second end of the shoulder strap.

4. The system of claim 1 wherein the length of the first and second connecting members are adjustable.

5. The system of claim 3 wherein the length of the shoulder strap is adjustable.

6. The system of claim 1 further comprising a first fastener retaining the first bag flap in the closed position.

7. The system of claim 6 further comprising a second fastener retaining the second bag flap in the closed position.

8. The system of claim 1 wherein the first bag flap is fixedly connected to the first bag.

9. The system of claim 1 wherein the first bag flap is releasably connected to the first bag.

10. The system of claim 9 further comprising a snap connector connecting the first bag flap to the first bag.

11. The system of claim 1 further comprising at least one reinforcement member in the base of at least one of the first bag and the second bag.

12. The system of claim 1 further comprising at least one stabilizer in at least one of the first bag and the second bag.

13. The system of claim 1 further comprising a liner in at least one of the first bag and the second bag.

* * * * *